US006354368B1

(12) United States Patent
Nishishita et al.

(10) Patent No.: US 6,354,368 B1
(45) Date of Patent: Mar. 12, 2002

(54) FIN FOR A ONE-PIECE HEAT EXCHANGER AND METHOD OF MANUFACTURING THE FIN

(75) Inventors: Kunihiko Nishishita; Takashi Sugita, both of Konan (JP)

(73) Assignees: Zexel Corporation; Toyo Radiator Co., Ltd., both of Tokyo (JP)

( * ) Notice: Subject to any disclaimer, the term of this patent is extended or adjusted under 35 U.S.C. 154(b) by 0 days.

(21) Appl. No.: 09/530,484

(22) PCT Filed: Nov. 13, 1998

(86) PCT No.: PCT/JP98/05121

§ 371 Date: May 1, 2000

§ 102(e) Date: May 1, 2000

(87) PCT Pub. No.: WO99/26035

PCT Pub. Date: May 27, 1999

(30) Foreign Application Priority Data

Nov. 13, 1997 (JP) ..... 9-329537

(51) Int. Cl.[7] ..... F28F 13/00
(52) U.S. Cl. ..... 165/135; 165/140
(58) Field of Search ..... 165/135, 140; 29/890.03; 72/186, 187

(56) References Cited

U.S. PATENT DOCUMENTS

| | | | | |
|---|---|---|---|---|
| 2,018,922 A | | 10/1935 | Palmer | |
| 3,766,873 A | * | 10/1973 | Narog | 72/186 |
| 3,850,018 A | * | 11/1974 | Drosnin | 72/186 |
| 5,033,540 A | * | 7/1991 | Tategami et al. | 165/135 |
| 5,186,034 A | * | 2/1993 | Hunt | 72/187 |
| 5,937,519 A | * | 8/1999 | Strand | 29/890.03 |
| 5,992,514 A | * | 11/1999 | Sugimoto et al. | 165/135 |
| 6,095,239 A | * | 8/2000 | Makino et al. | 165/140 |

FOREIGN PATENT DOCUMENTS

| | | |
|---|---|---|
| EP | 0 431 917 | 6/1991 |
| EP | 0 641 615 | 3/1995 |
| EP | 0 773 419 | 5/1997 |
| JP | 3-177795 | 8/1991 |
| JP | 6-45155 | 11/1994 |
| JP | 9-138084 | 5/1997 |

* cited by examiner

*Primary Examiner*—Allen Flanigan
(74) *Attorney, Agent, or Firm*—Wenderoth, Lind & Ponack, L.L.P.

(57) ABSTRACT

The present invention provides fins utilized in an integrated heat exchanger that achieve a highly effective prevention of heat conduction, do not create any cuttings during their formation and achieve a high degree of dynamic strength and a method for manufacturing these fins. The fins are each provided with a heat transfer prevention portion at the apex located between tubes of adjacent heat exchangers and the fins are formed by implementing, at least, a slit formation step in which at least a pair of slits are formed over specific intervals at an approximate center of a fin material achieving a specific width along the direction of the width, a corrugating step in which the fin material is bent to achieve a corrugated shape so that the pair of slits are at the apex of the fin material along the direction in which the fin material advances, a heat transfer prevention portion formation step in which a heat transfer prevention portion is formed by folding the area between the pair of slits forming the apex portion to the opposite direction from the apex portion and a crest cutting step in which the corrugated fin material is cut to achieve a specific number of crests.

27 Claims, 8 Drawing Sheets

(a)

(b)

FIN FOR A ONE-PIECE HEAT EXCHANGER AND METHOD OF MANUFACTURING THE FIN

TECHNICAL FIELD

The present invention relates to fins used in an integrated heat exchanger which is constituted by providing a plurality of heat exchangers achieving different functions at the front and the rear with the fins shared by the plurality of heat exchangers and a method for manufacturing the fins.

BACKGROUND ART

The heat exchanger disclosed in Japanese Examined Utility Model Publication No. H6-45155 comprises a first heat exchanger and a second heat exchanger that share common fins and are provided parallel to each other. In this heat exchanger, slits are formed in the linear portions of the fins located between the first heat exchanger and the second heat exchanger so that the heat conduction occurring between the fins located closer to the first heat exchanger and the fins located closer to the second heat exchanger is minimized.

In addition, the duplex integrated heat exchanger disclosed in Japanese Unexamined Patent Publication No. H3-177795 achieves an integrated structure in which a first heat exchanger and a second heat exchanger that operate at different temperatures share fins, with one or a plurality of notched portions for cutting off heat conduction between the two heat exchangers formed in the middle areas of the fins along the widthwise direction. The publication also discloses that the notched portions are constituted of a plurality of slits formed by alternately slitting the opposite ends of the fins along the heightwise direction.

However, the examples of the prior art quoted above pose a problem in that since the slits or the notched portions are formed by completely cutting off the portions that are to form the slits or the notched portions, the cuttings create more waste. There is another problem in that the dynamic strength of the fins themselves is compromised.

Accordingly, an object of the present invention is to provide fins in an integrated heat exchanger which effectively prevent heat transfer, do not create cuttings during their formation and achieve a high degree of dynamic strength, and a method for manufacturing these fins.

SUMMARY OF THE INVENTION

In order to achieve the objects described above, according to the present invention, in an integrated heat exchanger comprising a plurality of heat exchangers achieving different functions that share fins laminated alternately with tubes, a heat transfer prevention portion is formed at a bent portion of each of the fins located between tubes of adjacent heat exchangers. As a result, since the heat transfer prevention portion, which is formed in the area located between tubes at the bent portion of the fins to be bonded to the tubes, is located at the position closest to the tubes, heat conduction occurring due to the difference between their temperatures is efficiently prevented.

In addition, the heat transfer prevention portion should be preferably formed by folding back at least one portion of the fin. It is also desirable that the folded portion formed by folding back one portion of the fin be provided with at least one projected portion that projects out toward the opposite side from the bent portion of the fin. Thus, since the heat transfer prevention portion is formed by bending backward the portion located at the fin bent portion between the tubes, it is possible to prevent any cuttings from being discharged. In addition, since the folded portion is constituted of at least one projected portion, the dynamic strength of the fin is improved.

The fin manufacturing method according to the present invention for manufacturing fins utilized in an integrated heat exchanger comprising a plurality of heat exchangers achieving different functions that share fins laminated alternately with tubes comprises, at least, a slit formation step in which at least a pair of slits are formed over a specific distance from each other at an approximate center of a fin material with a specific width along the widthwise direction, a corrugating step in which the fin material is bent in a corrugated pattern so that a bent portion is formed at the position where the pair of slits have been formed in the fin material along the direction in which the fin material advances, a heat transfer prevention portion formation step, in which a heat transfer invention portion is formed by folding back the portion between the slits constituting the bent portion in the fin material in a direction opposite from the direction in which the bent portion is bent and a crest cutting step in which corrugated fins formed at a specific pitch are cut to achieve a specific number of crests. In addition, a pitch adjustment step for adjusting the pitch of the corrugated fins may be implemented as well. Furthermore, it is desirable to implement a louver formation step for forming louvers in the fin material concurrently with the corrugating step.

In this method, the fin material achieving a specific width wound around, for instance, an uncoiler, is drawn out to first undergo the slit formation step, in which a pair or a plurality of sets of slits are formed at an approximate center along the direction of its width, and then to undergo the corrugating step, in which it is corrugated so that the portions where the slits are formed constitute bent portions in the fin material. Then, in the heat transfer prevention portion formation step, the area between the slits constituting the bent portion of the fin material is folded back in the opposite direction from the direction in which the bent portion is bent, and in the pitch adjustment step, the pitch of the corrugated fins is adjusted. In the crest cutting step, the corrugated fins formed at the specific pitch are cut to achieve a specific number of crests, to manufacture the fins described above with a high degree of efficiency.

In addition, it is desirable to slacken the fin material between the slit formation step and the corrugating step so that no excess tension is applied to the fin material during the corrugating step.

The pitch adjustment step includes a pitch reducing process implemented to achieve a specific pitch in the corrugated fin material, an intermediate setting process and a pitch setting process. In order to achieve consistency in the fin pitch, fins are first formed at a pitch smaller than a specific pitch and then the fin pitch is gradually adjusted to achieve the specific pitch so that the pitch is prevented from becoming larger due to the restorative force of the fins.

Furthermore, the corrugating step and the heat transfer prevention portion formation step should be preferably implemented at the same time. It is desirable to perform the corrugating step by employing a pair of roll gears, each having a plurality of projected portions projecting out in the radial direction and indented portions formed between the projected portions that interlock with each other with the projected portions of one roll gear fitted into the indented portions of the other roll gear. Thus, since the fins and the heat transfer prevention portions are formed continuously at the same time by a pair of roll gears, the number of work steps can be reduced and, at the same time, the work efficiency is improved.

To explain the method of forming the heat transfer prevention portions in more specific terms, each of the pair of roll gears is provided with a heat transfer prevention portion forming indented portion at the tip of each projected portion located at the position corresponding to the area between the pair of slits in the fin material and a heat transfer prevention portion forming projected portion formed at the base of each indented portion located at a position corresponding to the area between the pair of slits, and the heat transfer prevention portions are each formed by bending the area between the pair of slits in the fin material in the opposite direction from the direction in which the other portion of the fin material is bent between the heat transfer prevention portion forming projected portion and the heat transfer prevention portion forming indented portion.

DETAILED DESCRIPTION OF THE INVENTION

Figure 1:
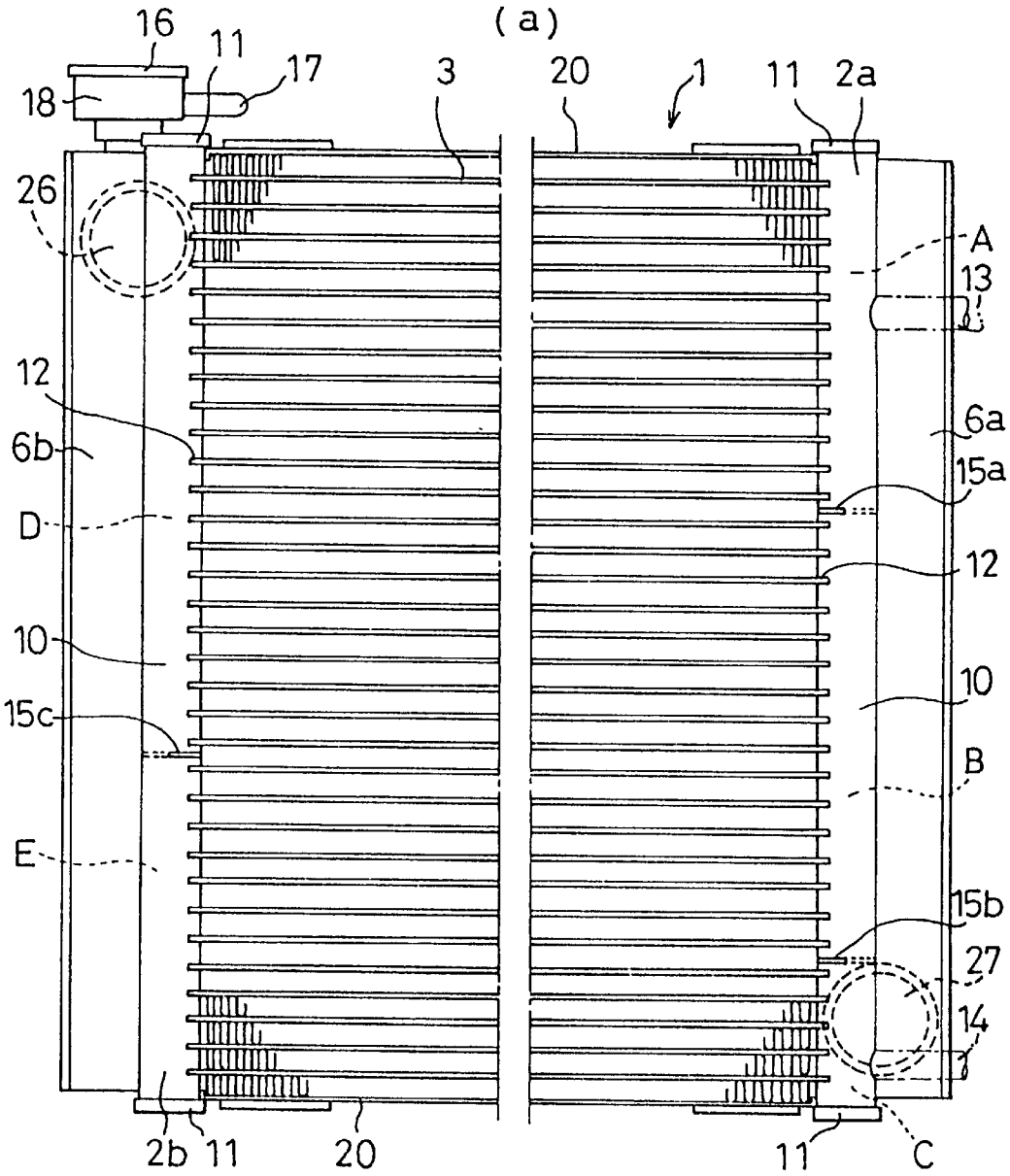
In FIG. 1, (a) is a front view of the integrated heat exchanger in an embodiment of the present invention and (b) is its plan view.
Figure 1:
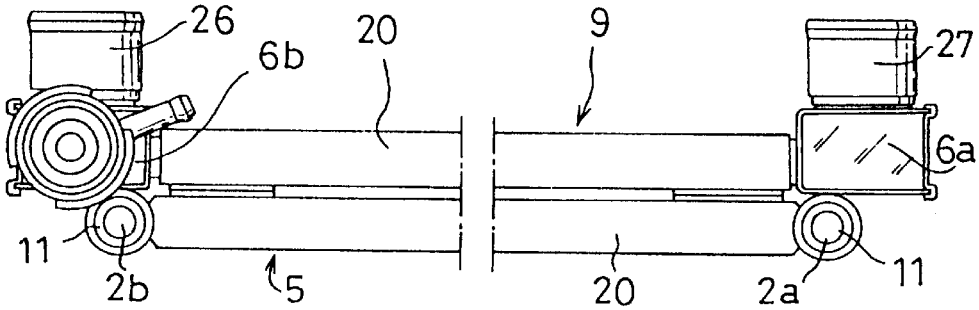

An integrated heat exchanger 1 in FIG. 1 is constituted of two different heat exchangers both formed from an aluminum alloy. The two heat exchangers are a condenser 5 and a radiator 9 in this embodiment.

Figure 2:
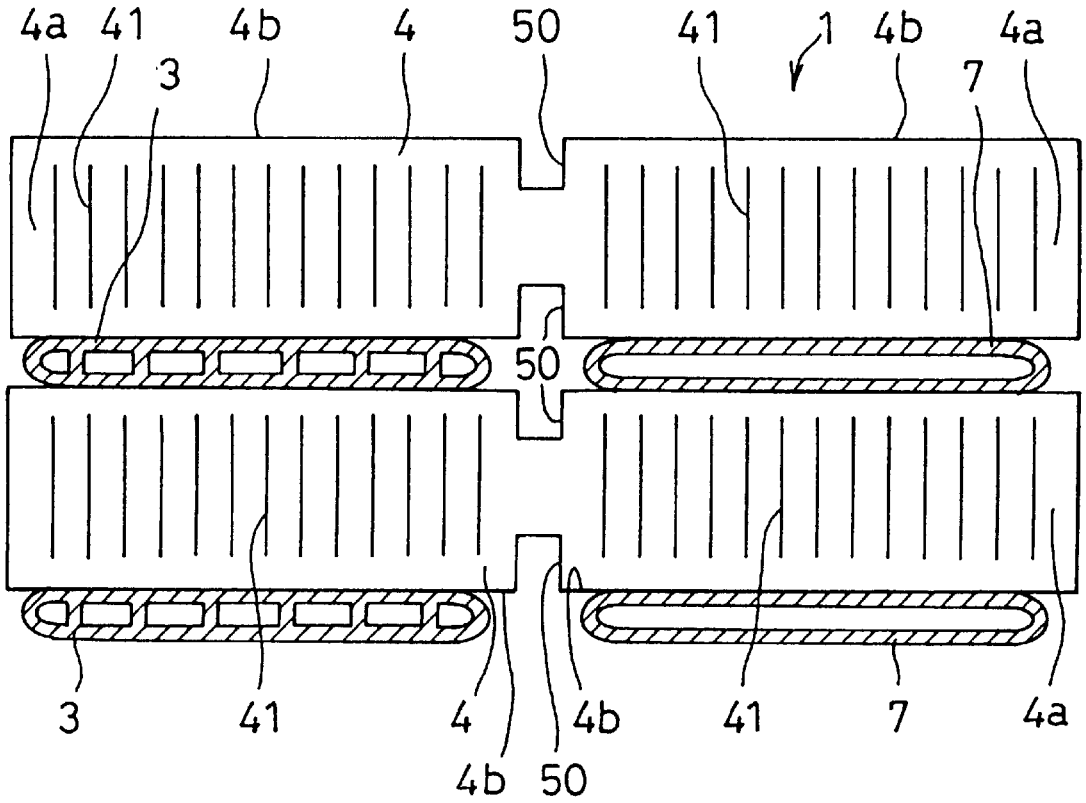
FIG. 2 is a partially enlarged illustration of the integrated heat exchanger in a first embodiment.

The condenser 5 comprises a pair of headers 2*a* and 2*b*, a plurality of flat tubes 3 communicating between the pair of headers 2*a* and 2*b* and corrugated fins 4 that are inserted and bonded between the tubes. It is to be noted that as illustrated in FIG. 2, the tubes 3 assume a shape of the known art achieved by partitioning the inner space thereof with numerous ribs to improve the strength, and may be formed through extrusion molding, for instance. In addition, the headers 2*a* and 2*b* at the condenser 5 are each constituted of a cylindrical member 10 and lids 11 that close off the openings of the cylindrical member 10 at the two ends, with tube insertion holes 12 through which the tubes 3 are inserted formed at the circumferential wall of the cylindrical member 10. Furthermore, the inner space of the header 2*a* is divided into three chambers A, B and C by partitioning walls 15*a* and 15*b*, and the inner space of the header 2*b* is divided into two chambers D and E by a partitioning wall 15*c*. The chamber A communicates with a coolant intake 13 and the chamber C communicates with a coolant outlet 14.

As a result, a coolant flowing from the coolant intake 13 into the chamber A then travels from the chamber A to the chamber D via the tubes 3 communicating between the chambers A and D, travels from the chamber D to the chamber B via the tubes 3 communicating between the chambers D and B, travels from the chamber B to the chamber E via the tubes 3 communicating between the chambers B and E and further travels from the chamber E to the chamber C via the tubes 3 communicating between the chambers E and C to be sent to the next process from the coolant outlet 14 via the chamber C.

The radiator 9 comprises a pair of headers 6*a* and 6*b* and a plurality of flat tubes 7 communicating between the pair of headers 6*a* and 6*b* and the fins 4 mentioned above that are inserted and bonded between the tubes. It is to be noted that the tubes 7 at the radiator 9 are each constituted of a flat tube with no partition inside, as shown in FIG. 2. In addition, an intake portion 26 through which a fluid substance flows in is provided at the header 6*b*, and an outlet portion 27 through which the fluid substance flow out is provided at the head 6*a*.

A filler neck 18, which is mounted with a cap 16 having a pressure valve is provided at the upper end of the header 6*b*, and an overflow pipe 17 is provided at the filler neck 18. As a result, if the radiator internal pressure rises, the fluid substance flows out to the outside through the overflow pipe 17 against the resistance of the pressure valve to enable adjustment of the internal pressure at the radiator 9.

Figure 3:
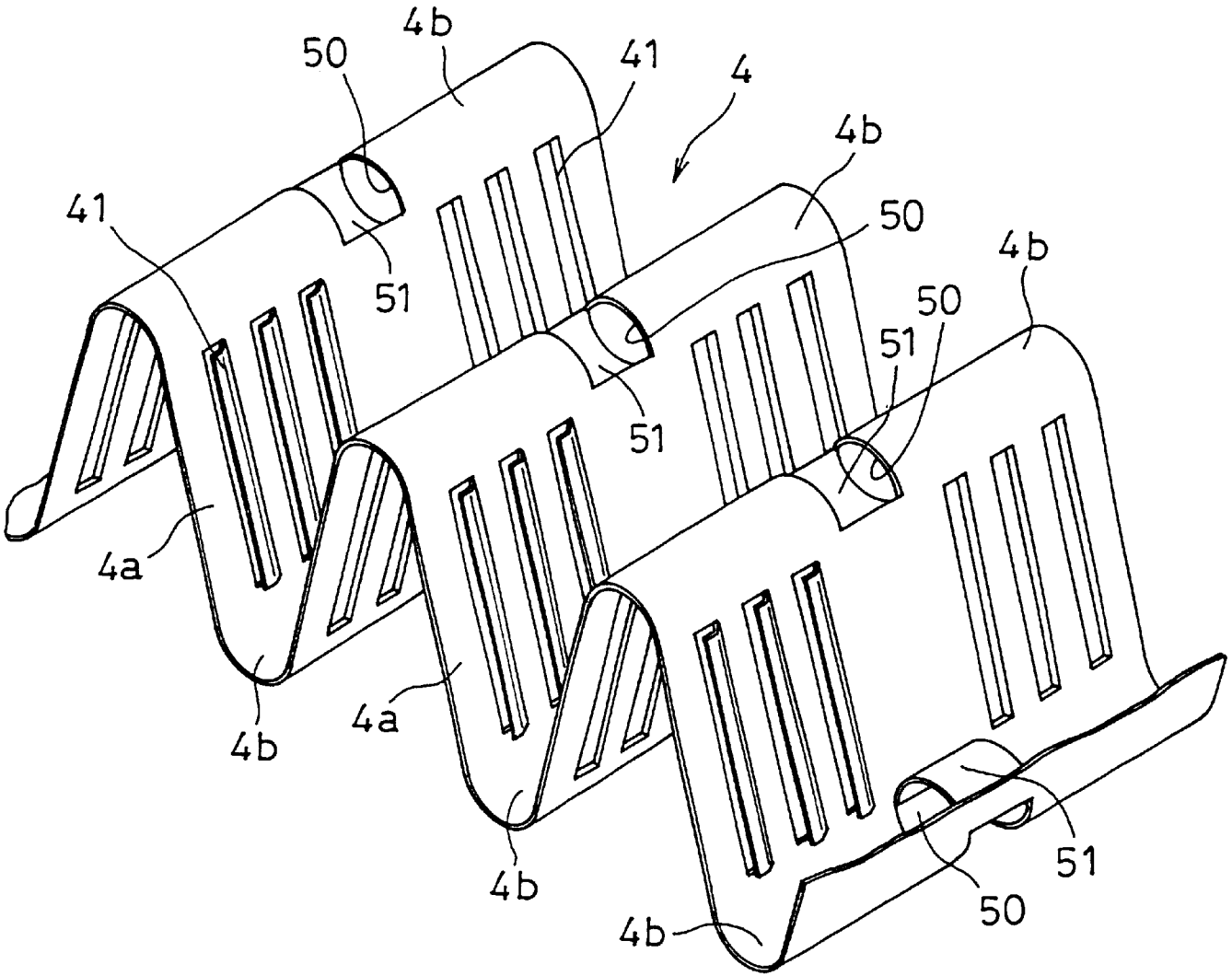
FIG. 3 is a partially enlarged perspective of the fins in the first embodiment.

The fins 4 continuously provided between the tubes 3 at the condenser 5 and between the tubes 7 at the radiator 9 are each provided with a plurality of louvers 41 formed in parallel along the widthwise direction in an inclined (intermediate) portion 4*a* of each fin 4, as illustrated in FIGS. 2 and 3, and are also each provided with heat transfer prevention portion 50 formed in the area between the contact position at which the bent portion 4*b* comes in contact with a tube 3 and the contact position at which the bent portion 4*b* comes into contact with a tube 7.

Figure 5:
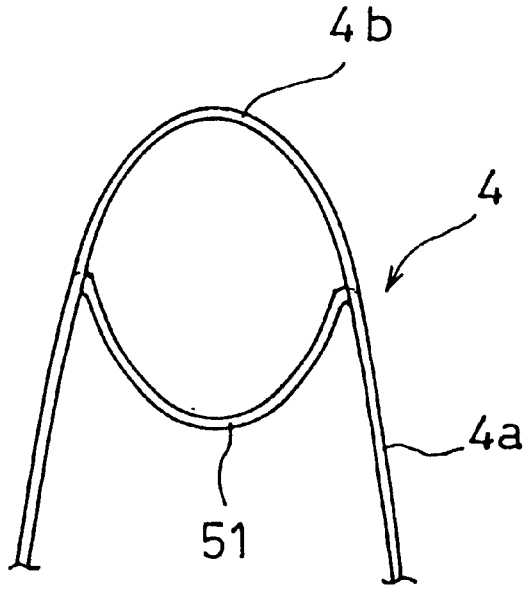
FIG. 5 is an enlarged view of the area around the bent portion of a fin in the first embodiment.

As illustrated in FIG. 5, the heat transfer prevention portion 50 in the first embodiment are each formed in a state in which a portion of the bent portion 4*b*, e.g., the area between the tube 3 and the tube 7 more specifically, is folded inward over a specific range, and a folded portion 51 thus formed constitutes a projected portion that projects out in the opposite direction (inward) from the direction in which the bent portion is formed. Thus, since the folded portion 51 is formed concurrently with the formation of the heat transfer prevention portion 50, no cuttings are created during the formation of the heat transfer prevention portion 50. In addition, the folded portion 51 spans between the inclined portions 4*a* as shown in FIG. 5. Thus, by forming the folded portion 51, the degree to which the dynamic strength of the fin 4 itself becomes reduced in the vicinity of the heat transfer prevention portion 50 can be minimized, and ultimately, the dynamic strength of the fin itself can be preserved.

Figure 4:
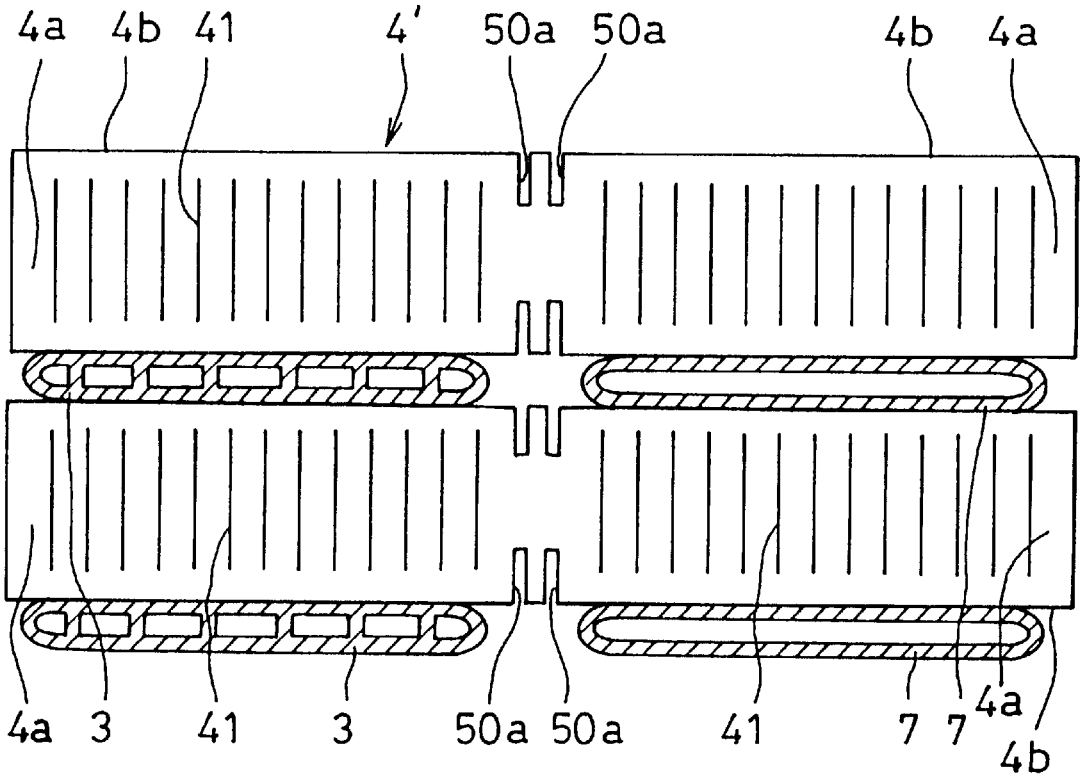
FIG. 4 is a partially enlarged illustration of the integrated heat exchanger in a second embodiment.

Fins 4' in the second embodiment illustrated in FIG. 4 are characterized in that a plurality of heat transfer prevention portions 50*a* are provided along the direction of the width of each fin. It is to be noted that while two heat transfer prevention portions 50*a* are formed in the widthwise direction in this embodiment, more than two heat transfer prevention portions may be formed. This will further improve the dynamic strength of the fins 4' and, at the same time, advantages similar to those achieved in the first embodiment are realized with respect to heat conduction.

Figure 6:
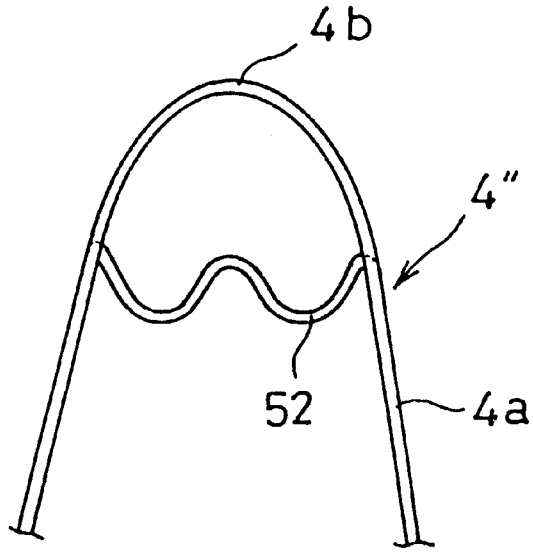
FIG. 6 is an enlarged view of the area around the bent portion of a fin in a third embodiment.

Furthermore, in a fin 4" in the third embodiment illustrated in FIG. 6, a folded portion 52 having a plurality of indented portions and a plurality of projected portions is formed in place of the folded portion 51 explained earlier to prevent any reduction in the dynamic strength of the fin 4" in the vicinity of the heat transfer prevention portion 50 or 50*a* to more effectively and ultimately preserve the dynamic strength of the fin itself.

Figure 7:
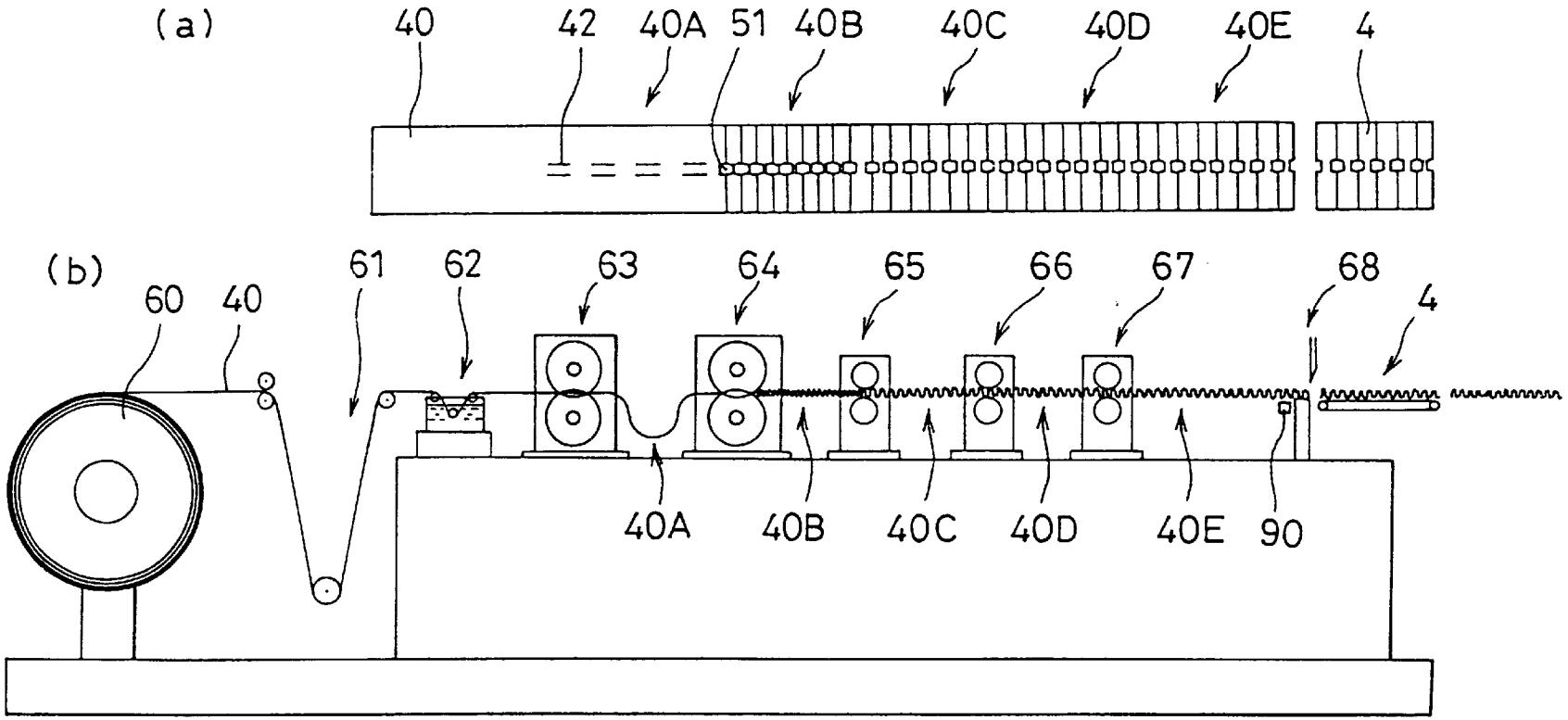
FIG. 7 illustrates the process of manufacturing the fins in the first embodiment, with (a) showing the fin material and (b) illustrating the manufacturing process.

While the fins 4, 4' and 4" structured as described above are all manufactured through the method illustrated in FIG. 7, the method for manufacturing the fins 4 is explained below as an example.

A fin material 40 wound around an uncoiler 60 is drawn out by a pulling device 61 at a specific speed, the slackness occurring when it is drawn out is corrected and then it is fed to an oil application device 62. At the oil application device 62, which implements an oil application step, the fin material 40 travels through oil so that the lubricating oil is applied to the entire surface before it is sent out to a slit forming device 63 that implements the next step.

Figure 8:
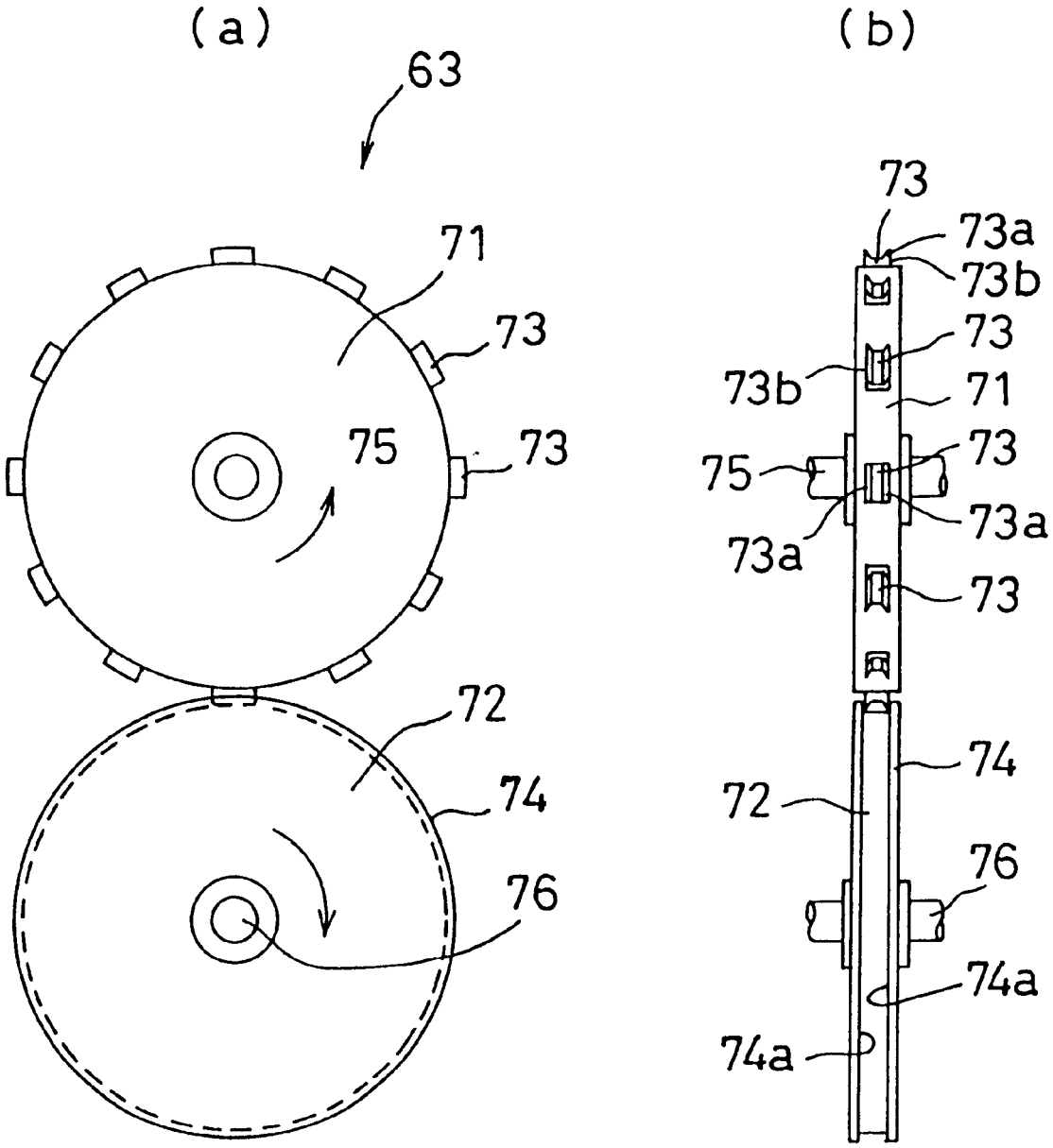
FIG. 8 shows the pair of roll gears in the slit forming device, with (a) presenting its front view and (b) presenting its side elevation.

The slit forming device 63, which implements the slit formation step, comprises a pair of roll gears 71 and 72 shown in FIGS. 8(*a*) and (*b*) and forms slits 42 successively over specific distances from each other at an approximate center of the fin material 40 in its widthwise direction. During the slit formation step, the fin material 40 becomes a fin material 40A having the slits 42 formed therein.

The roll gear 71 is provided with first tooth portions 73 positioned over a specific distance from each other at its external circumferential side surface, with the first tooth portions 73 each having a pair of teeth 73*a* with a specific width. A vertical surface 73*b* is formed at each of the two outer sides of each first tooth portion in the widthwise direction of the roll gear 71. The other roll gear 72 is provided with a second tooth portion 74 formed at its external circumferential side surface that interlocks with the first tooth portion 73, and the second tooth portion 74 is provided with a vertical surface 74*a* that slides in contact against the vertical surfaces 73*b* at each pair of teeth 73*a* of the roll gear 71 at each of the inner sides along the widthwise direction. While the second tooth portion 74 may be formed only over the area that slides in contact against the first tooth portion 73, it is formed continuously at the external circumferential side surface of the roll gear 72 in this embodiment. As a result, the first tooth portion 73 and the second tooth portion 74 slide in contact against each other continuously and the slits 42 can be formed successively. It is to be noted that reference numbers 75 and 76 in FIG. 8 each indicate a rotating shaft.

Then, the fin material 40A delivered from the slit forming device 63 is formed into a corrugated shape and becomes a fin material 40B having the louvers 41 and the heat transfer prevention portions 50 formed therein at a fin forming apparatus 64 that implements the corrugating step, the louver formation step and the heat transfer prevention portion formation step all at once. It is to be noted that at the fin forming apparatus 64, the fin material 40A is bent to achieve a corrugated shape so that the areas at which the slits 42 are formed constitute bent portions.

Figure 9:
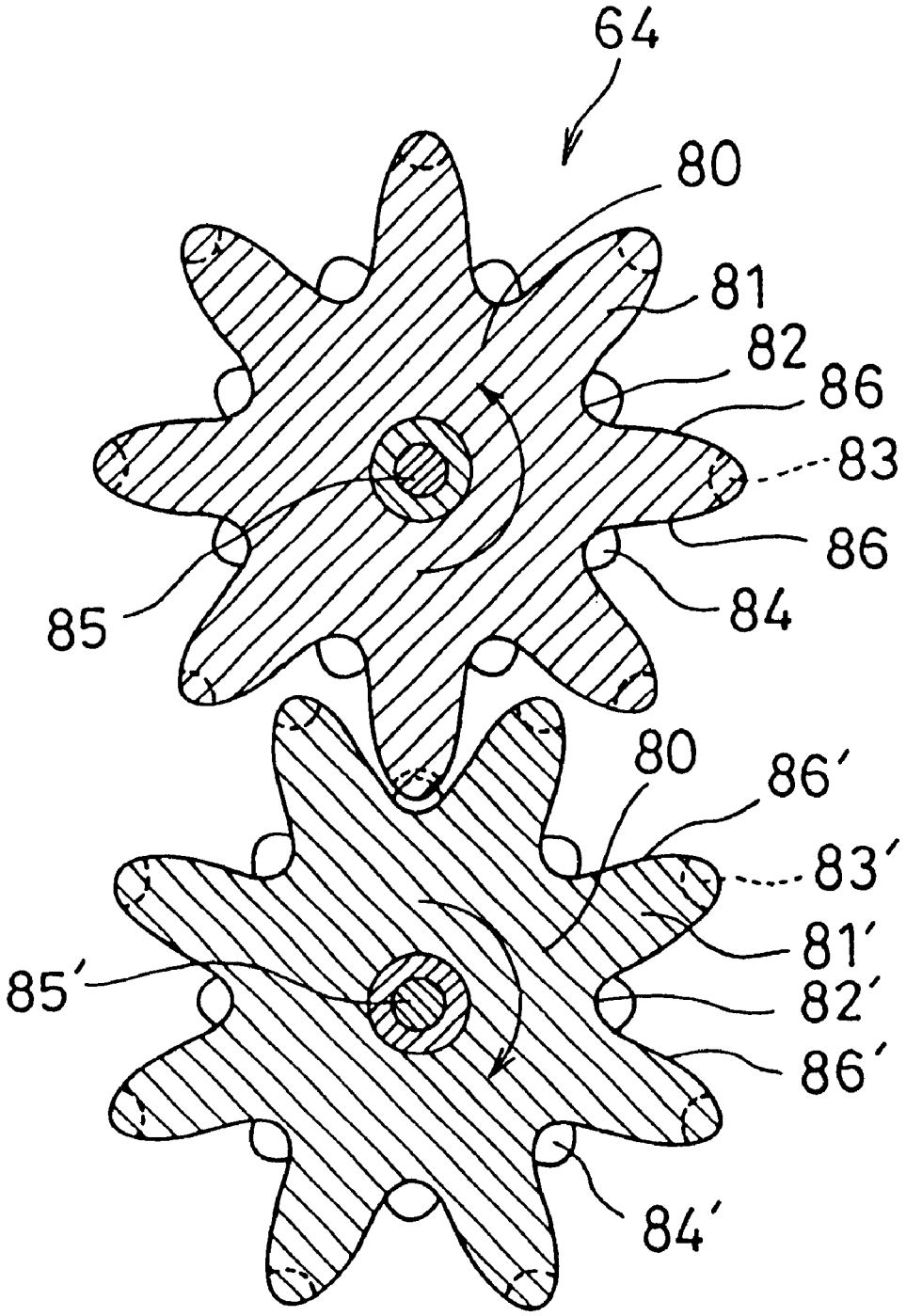
FIG. 9 is a sectional view of a pair of roll gears in a fin forming apparatus.

The fin forming apparatus 64 is constituted of a pair of roll gears 80 and 80' shown in FIG. 9, and the roll gears 80 and 80' are respectively provided with a plurality of fin forming projected portions 81 and a plurality of fin forming projected portions 81' that are evenly distributed along the circumferences of the roll gears 80 and 80' and project out in the radial direction, with a plurality of fin forming indented portions 82 and 82' formed between the fin forming projected portions 81 and between the fin forming projected portions 81' respectively. In addition, at side surface portions 86 and 86' ranging from the individual fin forming projected portions 81 and 81' to the adjacent fin forming indented portions 82 and 82' respectively, a plurality of teeth (not shown) for cutting the louvers in the fins 4 are formed.

The roll gears 80 and 80' interlock with each other with the fin forming projected portion 81 of the roll gear 80 fitting with the fin forming indented portions 82' of the roll gear 80', and the fin forming indented portions 82 of the roll gear 80 fitting with the fin forming projected portions 80' of the roll gear 80'. Consequently, the fin material 40A is corrugated.

In addition, at the tips (bent portions) of the fin forming indented portions 81 and 81', folded portion forming indented portions 83 and 83' having a width corresponding to the distance between the individual slits 42 are formed along the direction of the width of the fin material 40A, and at the bent portions of the fin forming indented portions 82 and 82', folded portion forming projected portions 84 and 84' having a width corresponding to the distance between the individual slits 42 are formed along the direction of the width of the fin material 40A. With the folded portion forming projected portions 83 of the roll gear 80 fitting with the folded portion forming indented portions 84' of the roll gear 80', and the folded portion forming indented portions 84 of the roll gear 80 fitting with the folded portion forming projected portions 83' of the roll gear 80', the folded portions 51 are formed at the fin material 40A. It is to be noted that in FIG. 9, reference numbers 85 and 85' each indicate a rotating shaft.

Then, the fin pitch at the fin material 40B that has been processed at the fin forming apparatus 64 is temporarily compressed between a pitch reducing device 65 and the fin forming apparatus 64 and is then adjusted at an intermediate setting device 66 so that the fin pitch becomes slightly expanded between the pitch reducing device 65 and the intermediate setting device 66, and thus, the fin material 40B becomes fins 40C. Next, an adjustment is performed by the intermediate setting device 66 and fins 40D with their pitch adjusted to achieve a specific value are formed between the intermediate setting device 66 and a pitch setting device 67. Then, the pitch setting device 67 performs a further adjustment to achieve fins 40E with a specific pitch. Thus, since the specific pitch is achieved by first reducing the fin pitch and then expanding it, it is possible to prevent the fin pitch from increasing due to the restorative force of the fins. Consequently, the fin pitch can be set equal to or less than the specific pitch at all times.

Furthermore, each time the corrugated fin material 40E achieving the specific pitch is delivered over a specific number of crests by a quantitative crest delivery device 90, the fin material 40E is cut by a crest cutting device 68 into individual fins 4 with a specific pitch having the folded portions 51 formed therein. It is to be noted that the quantitative crest delivery device 90 may be constituted by, for instance, using a multiple-start worm gear to deliver a specific number of crests.

In addition, the fin material 40A is slackened between the slit forming device 63 and the fin forming apparatus 64. Since any dimensional fluctuations occurring when corrugating the fin material 40A at the fin forming apparatus 64 are absorbed by this slack, the slits 42 can be formed in a stable manner.

Industrial Applicability

As explained above, according to the present invention, by folding a portion of a bent portion of a fin located between a plurality of heat exchangers constituting an integrated heat exchanger and sharing fins to form a heat transfer prevention portion, advantages are achieved in that the heat conduction between the heat exchangers is minimized, in that no cuttings are created since no holes are formed and in that the dynamic strength of the fins is preserved.

What is claimed is:

1. Fins for use in an integrated heat exchanger constituted of at least a first heat exchanger having a plurality of first tubes for a first heat exchanging medium and a second heat exchanger having a plurality of second tubes for a second heat exchanging medium, said fins comprising:

a corrugated sheet with alternating ridges and valleys formed by bent portions thereof and intermediate portions respectively extending between said bent portions, said bent portions being adapted to contact the first and second tubes of the first and second heat exchangers when said fins are disposed between an adjacent pair of the first tubes and an adjacent pair of the second tubes;

wherein apexes of said bent portions extend in a width direction of said corrugated sheet; and wherein said bent portions have heat transfer prevention openings therein respectively formed at mid portions thereof in the width direction, and folded portions respectively formed so as to be integral parts of said corrugated sheet and span between adjacent pairs of said intermediate portions in a direction generally perpendicular to said width direction, by bending portions of the respective bent portions to protrude in directions opposite to the directions in which said bent portions otherwise protrude, respectively.

2. Fins according to claim 1, wherein said folded portions respectively have single projected portions projecting in the directions opposite to the directions in which said bent portions otherwise protrude, respectively.

3. Fins according to claim 1, wherein said folded portions respectively have plural projected portions projecting in the directions opposite to the directions in which said bent portions otherwise protrude, respectively.

4. An integrated heat exchanger constituted of at least a first heat exchanger having a plurality of first tubes for a first heat exchanging medium, a second heat exchanger having a plurality of second tubes for a second heat exchanging medium and a plurality of fins disposed between an adjacent pair of said first tubes and an adjacent pair of said second tubes, said fins comprising:

a corrugated sheet with alternating ridges and valleys formed by bent portions thereof and intermediate portions respectively extending between said bent portions, said bent portions contacting said first and second tubes of said first and second heat exchangers;

wherein apexes of said bent portions extend in a width direction of said corrugated sheet; and wherein said bent portions have heat transfer prevention openings therein respectively formed at mid portions thereof in the width direction, and folded portions respectively formed so as to be integral parts of said corrugated sheet and span between adjacent pairs of said intermediate portions in a direction generally perpendicular to said width direction, by bending portions of the respective bent portions to protrude in directions opposite to the directions in which said bent portions otherwise protrude, respectively.

5. Fins according to claim 4, wherein said folded portions respectively have single projected portions projecting in the directions opposite to the directions in which said bent portions otherwise protrude, respectively.

6. Fins according to claim 4, wherein said folded portions respectively have plural projected portions projecting in the directions opposite to the directions in which said bent portions otherwise protrude, respectively.

7. A method of manufacturing fins for use in an integrated heat exchanger constituted of at least a first heat exchanger having a plurality of first tubes for a first heat exchanging medium and a second heat exchanger having a plurality of second tubes for a second heat exchanging medium, said method comprising:

forming, in a fin-material sheet, pairs of slits at specific intervals in a longitudinal direction of said fin-material sheet at a mid portion of said fin-material sheet in a width direction thereof;

forming said fin-material sheet into a corrugated sheet with alternating ridges and valleys formed by bent portions thereof and intermediate portions respectively extending between said bent portions, wherein apexes of said bent portions extend in a width direction of said corrugated sheet, said bent portions being adapted to contact the first and second tubes of the first and second heat exchangers when said fins are disposed between adjacent pairs of the first tubes and adjacent pairs of the second tubes;

forming heat transfer prevention openings at said bent portions by bending the portions of said corrugated sheet in areas between said slits so as to protrude in directions opposite to the directions in which said bent portions protrude, respectively, so as to form folded portions which are constituted as integral parts of said corrugated sheet and span between adjacent pairs of said intermediate portions in a direction generally perpendicular to said width direction; and cutting the corrugated sheet generally along the width direction thereof at specific intervals in the longitudinal direction.

8. A method according to claim 7, further comprising adjusting a corrugation pitch of said fin-material sheet.

9. A method according to claim 8, wherein said adjusting of said corrugation pitch comprises a pitch reducing process of forming a corrugation pitch smaller than a specified corrugation pitch, an intermediate setting process of increasing the corrugation pitch formed in said pitch reducing process, and a pitch setting process of further increasing the corrugation pitch set in said intermediate setting process to said specified corrugation pitch.

10. A method according to claim 9, wherein said forming of said fin-material sheet into a corrugated sheet and said forming of said heat transfer prevention openings are carried out concurrently.

11. A method according to claim 9, wherein said forming of said fin-material sheet into a corrugated sheet is carried out with a pair of roll gears, each of which has a plurality of projecting portions projecting out in a radial direction and a plurality of indented portions formed alternatingly between said projecting portions, said projecting portions of one of said roll gears engaging with said indented portions of the other of said roll gears, and said projecting portions of said other of said roll gears engaging with said indented portions of said one of said roll gears.

12. A method according to claim 8, wherein said fin-material sheet is slackened between said forming of said slits and said forming of said fin-material sheet into a corrugated sheet.

13. A method according to claim 8, wherein said forming of said fin-material sheet into a corrugated sheet and said forming of said heat transfer prevention openings are carried out concurrently.

14. A method according to claim 8, wherein said forming of said fin-material sheet into a corrugated sheet is carried out with a pair of roll gears, each of which has a plurality of projecting portions projecting out in a radial direction and a plurality of indented portions formed alternatingly between said projecting portions, said projecting portions of one of said roll gears engaging with said indented portions of the other of said roll gears, and said projecting portions of said other of said roll gears engaging with said indented portions of said one of said roll gears.

15. A method according to claim 7, further comprising concurrently with said forming of said fin-material sheet into a corrugated sheet, forming louvers in said fin-material sheet.

16. A method according to claim 15, wherein said fin-material sheet is slackened between said forming of said slits and said forming of said fin-material sheet into a corrugated sheet.

17. A method according to claim 15, wherein said adjusting of said corrugation pitch comprises a pitch reducing process of forming a corrugation pitch smaller than a specified corrugation pitch, an intermediate setting process of increasing the corrugation pitch formed in said pitch reducing process, and a pitch setting process of further increasing the corrugation pitch set in said intermediate setting process to said specified corrugation pitch.

18. A method according to claim 15, wherein said forming of said fin-material sheet into a corrugated sheet and said forming of said heat transfer prevention openings are carried out concurrently.

19. A method according to claim 15, wherein said forming of said fin-material sheet into a corrugated sheet is carried out with a pair of roll gears, each of which has a plurality of projecting portions projecting out in a radial direction and a plurality of indented portions formed alternatingly between said projecting portions, said projecting portions of one of said roll gears engaging with said indented portions of the other of said roll gears, and said projecting portions of said other of said roll gears engaging with said indented portions of said one of said roll gears.

20. A method according to claim 7, wherein said fin-material sheet is slackened between said forming of said slits and said forming of said fin-material sheet into a corrugated sheet.

21. A method according to claim 20, wherein said adjusting of said corrugation pitch comprises a pitch reducing process of forming a corrugation pitch smaller than a specified corrugation pitch, an intermediate setting process of increasing the corrugation pitch formed in said pitch reducing process, and a pitch setting process of further increasing the corrugation pitch set in said intermediate setting process to said specified corrugation pitch.

22. A method according to claim 20, wherein said forming of said fin-material sheet into a corrugated sheet and said forming of said heat transfer prevention openings are carried out concurrently.

23. A method according to claim 20, wherein said forming of said fin-material sheet into a corrugated sheet is carried out with a pair of roll gears, each of which has a plurality of projecting portions projecting out in a radial direction and a plurality of indented portions formed alternatingly between said projecting portions, said projecting portions of one of said roll gears engaging with said indented portions of the other of said roll gears, and said projecting portions of said other of said roll gears engaging with said indented portions of said one of said roll gears.

24. A method according to claim 7, wherein said forming of said fin-material sheet into a corrugated sheet and said forming of said heat transfer prevention openings are carried out concurrently.

25. A method according to claim 24, wherein said forming of said fin-material sheet into a corrugated sheet is carried out with a pair of roll gears, each of which has a plurality of projecting portions projecting out in a radial direction and a plurality of indented portions formed alternatingly between said projecting portions, said projecting portions of one of said roll gears engaging with said indented portions of the other of said roll gears, and said projecting portions of said other of said roll gears engaging with said indented portions of said one of said roll gears.

26. A method according to claim 7, wherein said forming of said fin-material sheet into a corrugated sheet is carried out with a pair of roll gears, each of which has a plurality of projecting portions projecting out in a radial direction and a plurality of indented portions formed alternatingly between said projecting portions, said projecting portions of one of said roll gears engaging with said indented portions of the other of said roll gears, and said projecting portions of said other of said roll gears engaging with said indented portions of said one of said roll gears.

27. A method according to claim 26, wherein a heat transfer prevention opening-forming indented portion is formed at a tip portion of each of said projected portions of each of said roll gears at positions for engaging said fin-material sheet at alternating ones of said areas between said slits; and a heat transfer prevention opening-forming projecting portion is formed at a bottom portion of each of said indented portions of each of said roll gears at positions for engaging said fin-material sheet at the other alternating ones of said areas between said slits.

* * * * *